US005794829A

United States Patent [19]

Perrault

[11] Patent Number: 5,794,829

[45] Date of Patent: Aug. 18, 1998

[54] DEVICE FOR LATERAL REGISTER ADJUSTMENT OF A WEB OF MATERIAL

[76] Inventor: Michael Roger Perrault, 82 Blackwater Rd., Rochester, N.H. 03867

[21] Appl. No.: 774,160

[22] Filed: Dec. 26, 1996

[51] Int. Cl.[6] ..... B65H 23/02; B65H 23/038; D06C 3/00

[52] U.S. Cl. ..... 226/18; 226/3; 26/75

[58] Field of Search ..... 226/15, 18, 20, 226/199; 26/75, 77, 90

[56] References Cited

U.S. PATENT DOCUMENTS

| | | | |
|---|---|---|---|
| 2,840,722 | 6/1958 | Frommer | 226/15 X |
| 3,156,396 | 11/1964 | Snyder et al. | 26/77 X |
| 3,414,954 | 12/1968 | Alexeff | 26/75 |
| 3,637,121 | 1/1972 | Alexeff | 26/77 |
| 4,322,026 | 3/1982 | Young, Jr. | 226/15 |
| 4,417,516 | 11/1983 | Fischer . | |
| 5,067,646 | 11/1991 | Young, Jr. et al. | 226/15 |
| 5,119,981 | 6/1992 | Gnuechtel et al. | 226/15 |
| 5,138,341 | 8/1992 | Kobayashi | 226/15 X |
| 5,138,944 | 8/1992 | Rancourt et al. . | |
| 5,415,118 | 5/1995 | Adamski, Jr. et al. | 226/15 X |

OTHER PUBLICATIONS

"Register Correction Wheel Model 460", Baldwin Worldwide Sales and Service.

*Primary Examiner*—Michael Mansen
*Attorney, Agent, or Firm*—Kenyon & Kenyon

[57] ABSTRACT

A device for width of print adjustment of a web of material, particularly a printed web of material, including at least one register correction wheel for deflecting a web of material, the register correction wheel being assigned to the path of the web of material. An actuating unit is assigned to the register correction wheel to move the register correction wheel for remote or automatic width of print adjustment. The actuating unit is integrated into the central press control system.

20 Claims, 5 Drawing Sheets

1
2
14
9
12
10
16
13
11
18
8
22
15
23
100
19
17
20
20.1
21
24

DEVICE FOR LATERAL REGISTER ADJUSTMENT OF A WEB OF MATERIAL

FIELD OF THE INVENTION

The present invention relates to a device for lateral register adjustment of a web of material, particularly a printed web of material that is printed on both sides.

BACKGROUND INFORMATION

The leaflet *Register Correction Wheel, Model* 460, distributed by Baldwin Gegenheimer Division, 417 Shippan Avenue, Stamford, Conn. 06902, U.S.A., purports to show a register correction wheel for fine-tuning the side register of a web of material. A register correction wheel is mounted in a bracket held by a spindle which can be moved upwards and downwards by a hand-wheel. The brackets are mounted on a bar extending over the width of the web of material. The register correction wheel is made of nylon with sealed, permanently lubricated ball bearings for less marking of the web and easy clean-up. However, lateral adjustment operations have to be performed by the press operator manually, which means frequent attention must be paid to the register correction wheels between the central press control and the respective locations where the register correction wheels are mounted.

German Patent Application No. DE 31 19 398 C2 purports to describe a device to adjust the length of a web path in a web-fed rotary printing press, in which a web of material can be guided on different paths from printing unit to printing unit. In this reference, several rollers are described which apply, to a lesser or greater extent, a tensioning force onto the web of material, dependent on the respective web path the web is to take on its way through the web-fed rotary printing press.

Register correction wheels, also referred to as bustle wheels, are used on web-fed rotary printing presses to alter the lateral position, or width-of-print, of a web of material when it is determined that a printing defect has occurred. When running a printing job on a web-fed rotary printing press, the operator should focus on quality requirements and a correct presetting of all adjustments to minimize waste of web materials and to save make-ready time; the operator should not be preoccupied with the manual adjustments of register correction wheels, particularly where a plurality of register correction wheels are being used in different locations of the rotary printing press. For example, each printing unit of a web offset printing press generally uses two bustle wheels, a left and a right, and the press includes four printing units, one for each primary printing color (black, blue, red and yellow), thus requiring the manual adjustment of up to eight bustle wheels. The manual adjustment process is time-consuming and can be more usefully dedicated to correct presetting operations, thereby contributing to quality control.

SUMMARY OF THE INVENTION accordance with the present invention, a device for width-of-print adjustment of a web of material, particularly a printed web of material, includes a register correction wheel for deflecting the web of material, an actuating unit driving the register correction wheel and a position monitoring circuit tracking the position of the register correction wheel. The register correction wheel is assigned to the path of the web of material for automatic width-of-print adjustments. The actuating unit can be integrated into the automatic press controls and is activated by the operator, for example by using a control panel located at the printing press control system. The control of the actuating unit also could be separate from the press control system. The actuating unit may also be activated by automatic press controls without intervention by the operator. The position monitoring circuit can include a variable resistance potentiometer that tracks the movement of the register correction wheel as a function of corresponding voltage changes in the potentiometer. In addition, the device according to the present invention can include a lateral adjustment mechanism for manual or automatic lateral positioning of register correction wheel.

Several advantages are obtained with the device according to the present invention. Since the width-of-print adjustment is performed automatically, there is no longer a need for the operator to rush between the printing units to manually adjust each bustle wheel and the press control system in order to maintain high-quality printing of signatures. For example, upon the detection of a print quality defect, the adjustments to the width-of-print via the register correction wheels can be made quickly and automatically from a central location. Thus, the number of wasted signatures printed can be significantly reduced. Further, the automation of register correction wheel adjustments reduces the time to discover a print defect and to make the corresponding adjustment of each register correction wheel. The automatic width-of-print adjustment also contributes to the press operator's safety, as there is no longer a need for the operator to climb into the printing units while the press is running and to perform the necessary adjustment of the register correction wheels manually.

According to further features of the device according to the present invention, the actuating unit for each register correction wheel is integrated into the press control system, thus allowing the register correction wheel to be positioned into a correct operating position such that it automatically reaches lateral positions in which it contacts the web of material in those zones carrying less ink as compared to other zones, even during presetting of the press. Consequently, the time-consuming manual adjustments during presetting of the press can be avoided by integrating the actuating units for the register correction wheels into the press control system.

By automatically adjusting the register correction wheel upwards and downwards, the risk of a web break during a splice can be significantly reduced by the device according to the present invention. Since the web is somewhat thicker at the splice, conventional manually adjusted register correction wheels, when in their upward-position, are difficult to quickly adjust into their retracted position so that the web splice can pass the register correction wheel without contact, thus avoiding possible ripping of the web. Using the automatic control according to the present invention, however, the retraction of the register correction wheel can be performed just when the splice position passes the register correction wheel, and after this has happened, the register correction wheel can be returned to its original retracted position again. The register correction wheels can be retracted, for example, upon splicing or web-up of the rotary printing press.

An automatically performed register correction wheel adjustment according to the present invention also can be initiated by a known register mark detection device integrated into a conventional press control system. The register mark detection device determines that a register correction is necessary and identifies the specific register correction wheel that needs to be adjusted. Once the amount of correction that is necessary is determined, the press control system provides a signal to the actuating unit(s), assigned to the specific register correction wheel, to automatically vertically and/or laterally adjust the register correction wheel. Alternatively, the press operator can initiate a remote-controlled register correction wheel adjustment after he has visually detected a print defect on a signature emerging from the signature delivery section of the press by entering the required correction into a remote-control terminal that is integrated into the press control system. Thus, either by closed-loop control or by operator's initiative, automatic adjustments of the register correction wheels can be performed according to the present invention.

DETAILED DESCRIPTION OF THE INVENTION

Figure 1:
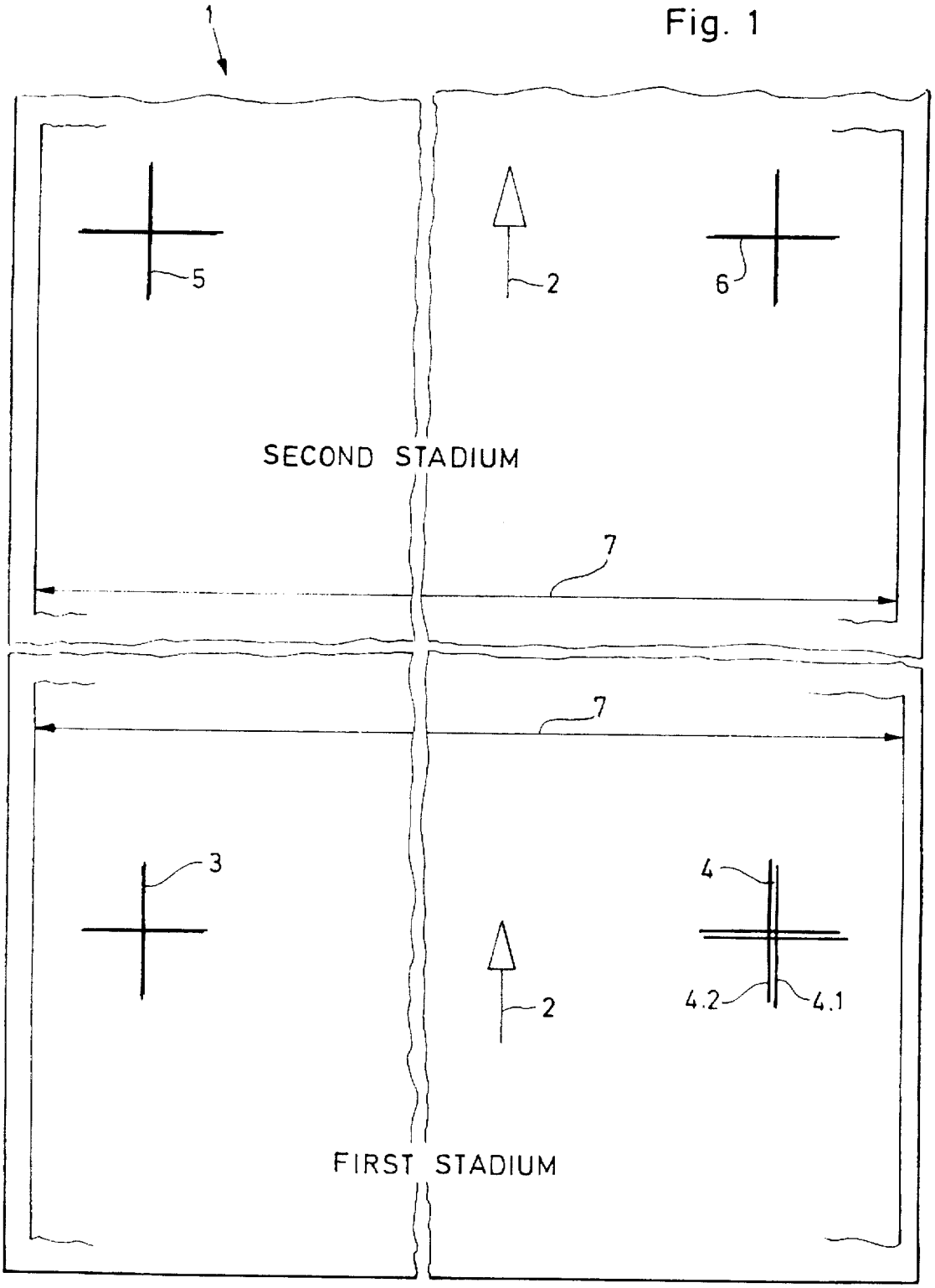
FIG. 1 shows a web of material having register marks indicating a print defect with regard to lateral register in a first stadium shown in the lower half of FIG. 1, and correction of the defect in a second stadium shown in the upper half of FIG. 1.

FIG. 1 shows a top view of a printed web of material. In the lower part of FIG. 1, a first stadium of the printed web of material 1 is shown. The web of material 1 running in the direction of the arrow 2 has a left register mark 3 which shows no print defect with respect to the lateral or circumferential register. However, the right register mark 4 indicates a lateral print quality defect, indicated by misaligned lines 4.1 and 4.2. The right register mark 4 indicates that there is width-of-print adjustment necessary in order to correct the width-of-print such that the misaligned lines 4.1 and 4.2 of the right register mark 4 turns into a register mark 6 on the right-hand side of the web of material 1, as shown in the upper half of FIG. 1 illustrating a second stadium of the web of material 1. The width-of-print adjustment for register mark 4 does not affect the position of the left register mark 5 shown in the upper half of FIG. 1.

Figures 2, 3:
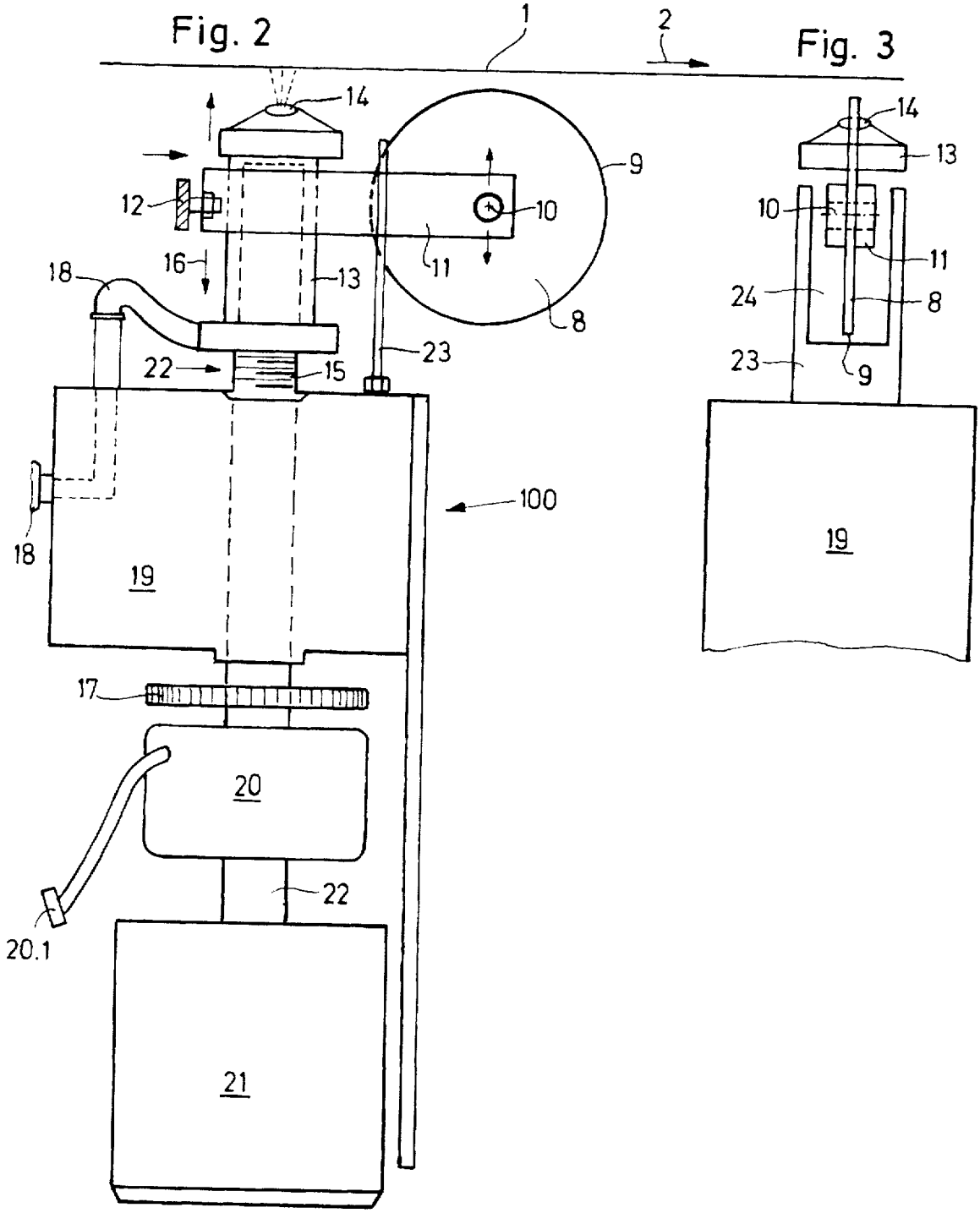
FIG. 2 is a schematic view of a register correction wheel assembly according to the present invention.
FIG. 3 is a respective front view of the register correction wheel assembly shown in FIG. 2.

The register correction assembly 100 includes, for example, a register correction wheel 8, an actuating unit 21 and a position monitoring device 20. The print defect, indicated in exaggerated scale by the misaligned lines 4.1 and 4.2 in defective register mark 4 in the lower half of FIG. 1, can be adjusted by the register correction wheel assembly according to the present invention shown in FIGS. 2 and 3. In order for the web of material 1 to be correctly aligned with the color printed onto the web of material 1 in the preceding printing unit, the register correction wheel 8 touches the lower surface of the web of material 1 to slightly deviate it with respect to the lateral print width 7. A lateral print defect up to several mils of an inch can be properly adjusted to compensate for the lateral print width defects. As shown in FIG. 2, the web of material 1 is conveyed through a horizontally extending conveying plane in the direction given by the arrow 2. Below the web of material 1 at least one register correction wheel 8 is located, although there is generally provided two register correction wheels, a left and a right, for each printing unit of a printing press.

The register correction wheel 8—one of which is shown in FIG. 2—rotates about an axis of rotation 10 mounted on a lever 11. The lever 11 is slidably mounted, for example, on a support 13 and moves upwards and downwards, as indicated by arrows 16. Consequently, the lever 11 having the register correction wheel 8 mounted thereon will move upwards and downwards so that the outer circumference 9 of the register correction wheel 8 touches the lower surface of the web of material 1. Upon contact of the outer circumference 9 of the register correction wheel 8 with the web of material 1, the web of material 1 will be slightly moved upwards, thereby effecting a more narrow width-of-print in the following printing unit.

The support 13, on which the lever 11 is slidably mounted, is also provided with a cone-shaped end having an air nozzle 14. On the lower end of the support 13 there is shown an air supply 18 directing air into the support 13 and through the air nozzle 14 to provide an air cushion below the web of material 1. The air nozzle 14 can be incorporated in and used as an alternative to the register correction assembly 100 according to the present invention. For example, if a signature, i.e. a printed portion of the web, had no "dead zone" (e.g., a location on the signature that is not printed), the use of a register correction wheel 8 would result in the wheel smearing the ink on the signature. In such a circumstance, pressurized air emitted from the air nozzle 14 can be used to manually direct a pressurized air stream towards the web of material 1, thereby causing deflection of the web of material 1 and effecting a width-of-print adjustment.

Figure 5:
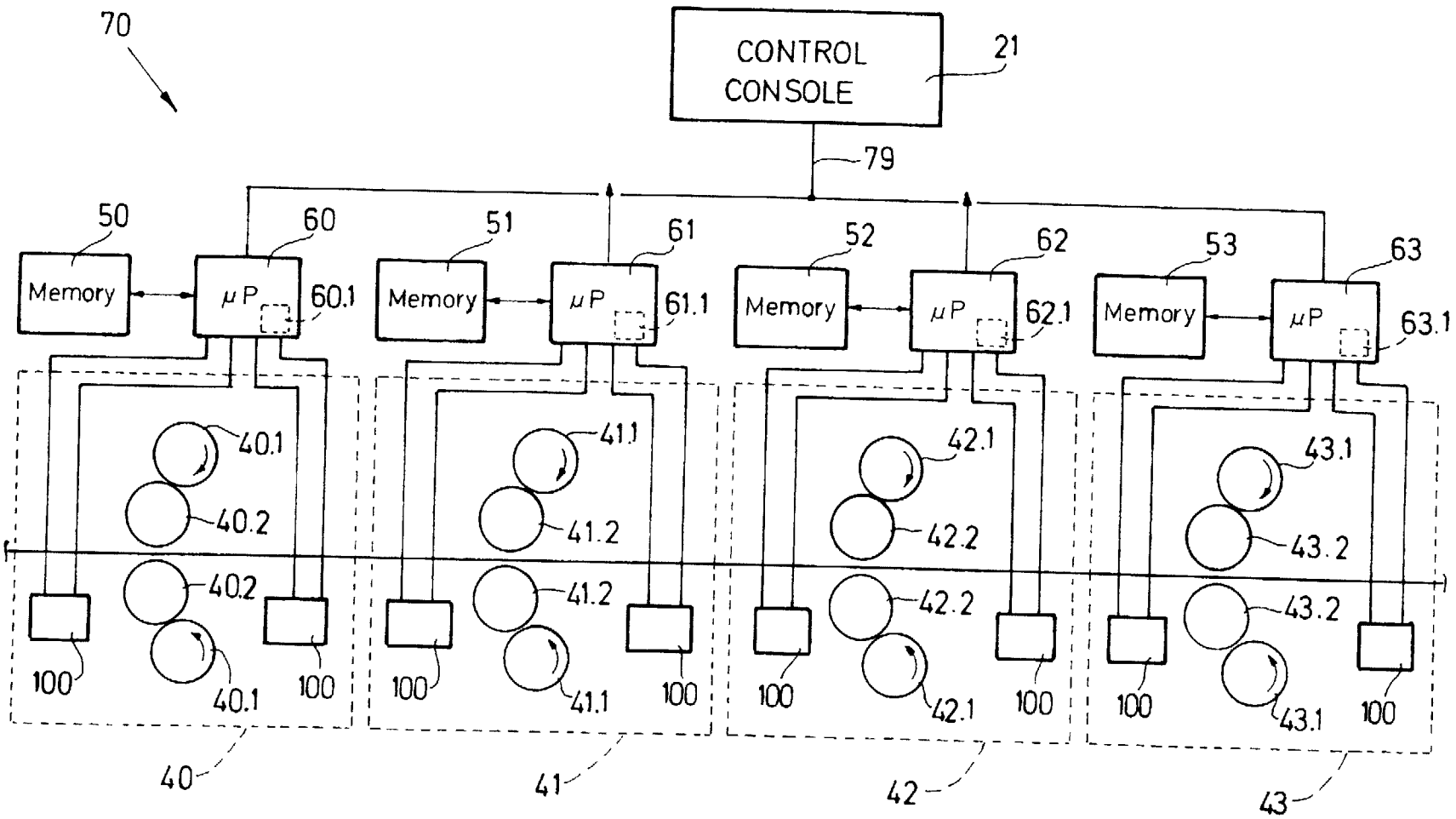
FIG. 5 shows a lithographic printing press including a register correction assembly according to the present invention.

The register correction assembly 100 according to the present invention may be housed, for example, in a respective printing unit 40, 41, 42, 43 of a lithographic printing press 70, as shown in FIG. 5. Although four printing units are shown in FIG. 5, it is understood that a different number of printing units may be incorporated in the printing press 70. Each printing unit 40, 41, 42, 43 includes upper and lower plate cylinders 40.1, 41.1, 42.1, 43.1 and upper and lower blanket cylinders 40.2, 41.2, 42.2, 43.2 which cooperate respectively with the upper and lower plate cylinders. The upper and lower blankets print on opposite sides of the web of material 1 as the web advances through each printing unit. Each register correction assembly 100, a left and right assembly being shown for each printing unit 40, 41, 42, 43 can effect a width-of-print adjustment to the web of material 1 passing through the printing unit.

As shown in FIG. 5, each printing unit 40, 41, 42, 43 includes the register correction assembly 100 according to the present invention that is associated with a respective distributed microprocessor 60, 61, 62, 63 (e.g., an embedded controller) communicating with respective computer storage memories 50, 51, 52, 53. As Microprocessors are readily available in the commercial market, their internal structure and operation are well known in the art and, therefore, the microprocessors 60, 61,62 and 63 will not be described in detail herein. Each of the microprocessors 60, 61, 62, 63 are connected to the press control system 27.

Figure 4:
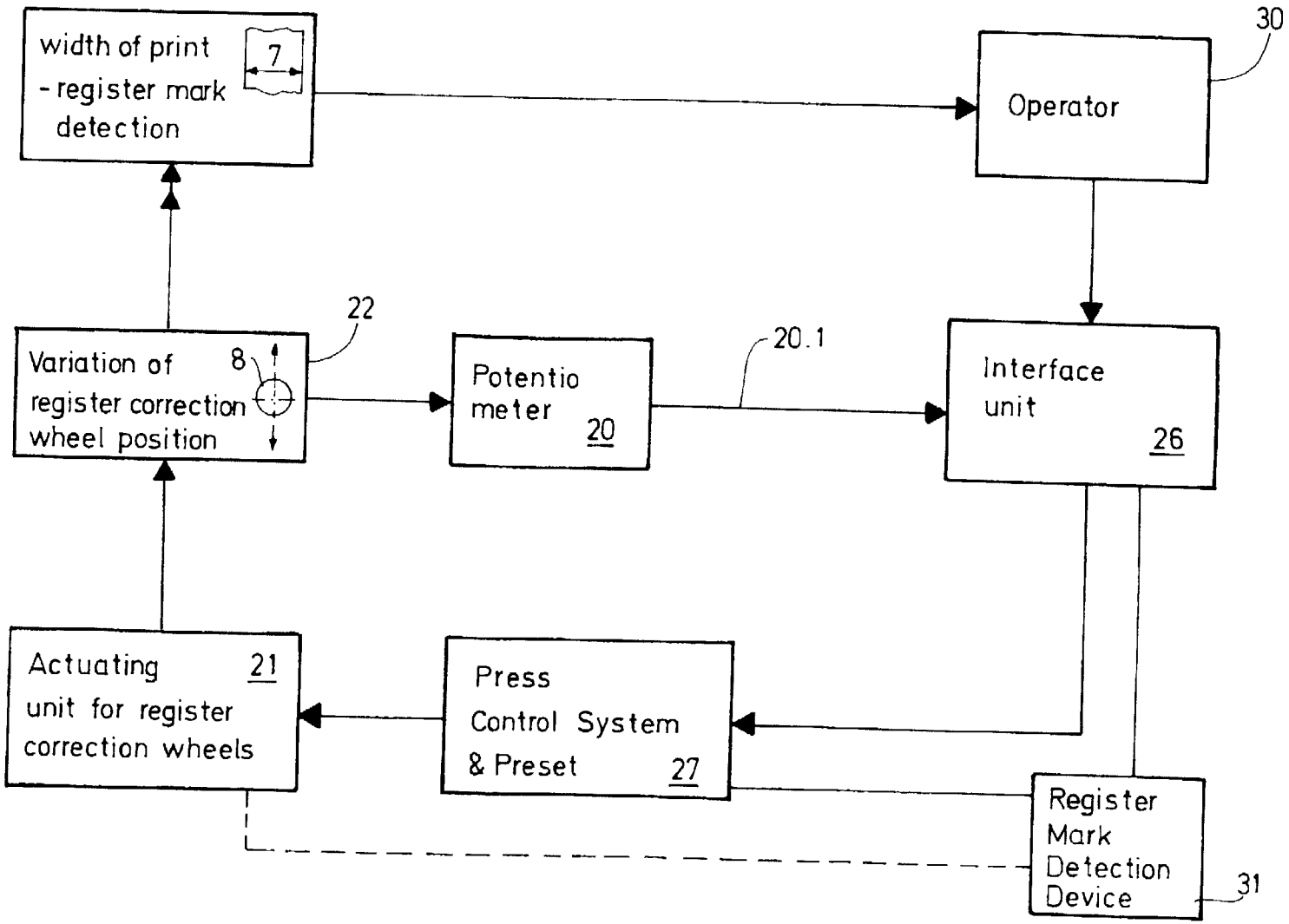
FIG. 4 shows a schematic closed-loop control circuit for the control of the register correction wheels according to the present invention.

As shown in FIG. 2, the lever 11 to which the register correction wheel 8 is attached is moved, for example, via a spindle 22 having a threading 15. The spindle 22 extends through a housing 19. The spindle 22 is connected to a potentiometer 20 and an actuating unit 21, which are attached, for example, to a central press control system 27, as shown in FIG. 4, via circuit cables 20.1 and 20.2. The central press control system 27, as is known in the art, controls web-up, splicing procedures, presetting of ink keys and many other automatic functions of the printing press. For example, the central press control system may include a Heidelberg Harris Graphics Control System for a M1000 or M850 web offset press.

The spindle 22 is driven by the actuating unit 21, such as an electric motor or any other suitable actuating means, based on a control signal from the press control system 27 transmitted via cable 20.2. In addition, the movement of the spindle 22 is monitored by the potentiometer 20 and the movement measurement can be fed back to the press control system 27 via cable 20.1. For example, potentiometer 20 can include a variable resistance potentiometer that outputs a voltage dependent on spindle position (e.g., movement of the spindle 22 causes the voltage of the potentiometer 20 to change, an initial voltage level being associated with a reference position of the spindle 22 and thus the register correction wheel 8). Thus, when a print defect is detected, the press control system 27 sends a control signal to the actuating unit 21 to drive the spindle 22, thereby moving the register correction wheel 8 to make an appropriate width-of-print adjustment to the signature.

For example, the control signal can be transmitted from the press control system 27 to an embedded controller of the respective print unit where the width-of-print adjustment has to be made, the embedded controller also being connected to the press control system 27. The embedded controller, for example, the microprocessors 60, 61, 62, 63 shown in FIG. 5, then routes the control signal, for example, from the press control system 27, to the actuating unit 21, via, for example, an I/O driver, 60.1, 60.2, 60.3, 60.4 as is known in the art, thus causing the spindle 22 to move in response to the control signal. The position of the spindle 22 is tracked by the potentiometer 20, which continuously provides its voltage to the embedded controller, also via the I/O driver, so that the embedded controller can determine when the desired position of the register correction wheel has been reached. The position of the register correction wheel can be displayed, for example, on a display of the press control system 27 via an LED display.

An adjustment wheel 17 is mounted on the lower end of the housing 19 for manual control of the register correction wheel 8, if desired by the operator. Even manual control of the register correction wheel 8, however, still results in the position of the register correction wheel 8 being tracked by the potentiometer 20 in the manner described above. In addition, the control signal can be transmitted from a control unit separate from the press control system 27, such as a stand-alone control unit only for the registration wheel assembly. Thus, the register correction wheel assembly according to the present invention allows, for example, a spliced web, which at the splice has a significantly increased thickness, to pass through the printing press with the bustle wheels lowered to prevent tearing of the web from the splice contacting the bustle wheels. In addition, subsequent return of the bustle wheels to their prior position automatically is provided for as the prior position of each bustle wheel is indicated by the voltage at its associated potentiometer 20 and can be stored by the press control system 27. Similar lowering of the bustle wheels and automatic return to the prior position is also possible for web-up and blanket wash operations.

FIG. 3 shows the register correction wheel 8 in a front view, as seen in the direction of web travel, the register correction wheel 8 being turned 90° as compared to FIG. 2. As shown in FIG. 3 the outer circumference 9 of the register correction wheel 8 mounted in the lever 11 is deployed at a height below, equal to or greater than the web height, while the air nozzle 14 is non-contacting and thus deployed at a height lower than the web height. The register correction wheel 8 is surrounded, for example, by bracket 23 mounted on the housing 19, the bracket 23 supporting the register correction wheel 8. The lever 11 having the register correction wheel 8 mounted thereon extends through a recess 24 in the bracket 23.

Figure 6:
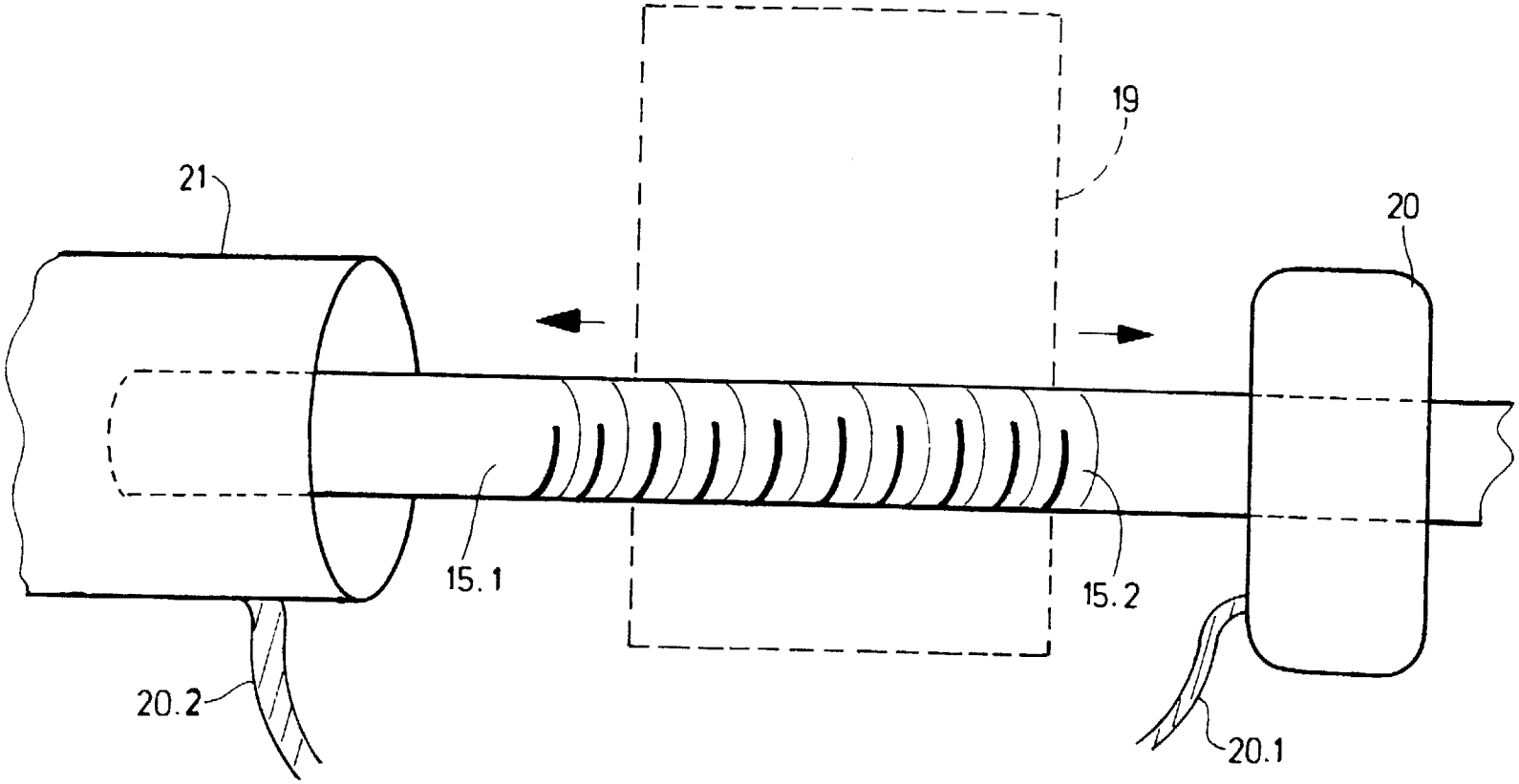
FIG. 6 illustrates another embodiment of the device according to the present invention providing lateral adjustment.

The register correction wheel assembly 100 according to the present invention also provides for lateral movement of the register correction wheel 8 as well as vertical of the register correction wheel 8. As shown in FIG. 6, lateral movement of the register correction wheel 8 can be provided, for example, in a similar manner to vertical movement of the register correction wheel 8. For example, the housing 19 can be movably connected to a threaded rod 15.1 via a threaded connection 15.2. An actuating unit 21' and a movement control unit 20' are connected, for example, to the threaded rod 15.1 and to the press control system 27 via circuit cables 20.1' and 20.2' to allow a control signal from the press control system 27 to be provided to the actuating unit 21'. The actuating unit 21' will drive the rotation of the threaded rod 15.1 to laterally move the housing 19 via the threaded connection 15.2 and thereby the register correction wheel assembly 100 connected to the housing 19. The movement monitoring circuit 20', such as a variable resistance potentiometer, tracks the lateral position of the housing 19 via the voltage of the potentiometer and feeds the movement data to the embedded controller of the printing unit in the same manner as described for the vertical movement of the register wheel assembly 100.

FIG. 4 is a schematic view of the steps involved with a width-of-print adjustment performed according to the present invention. In conventional offset printing operations, the press operator 30 constantly pulls sample signatures to check the quality of the printed product. The criteria checked are, for example, accuracy of the folds, the circumferential and lateral register, proper transversal or longitudinal cuts or both, etc. Upon detection of a print defect, such as that shown in the lower half of FIG. 1 at register mark 4, the operator 30 determines that a correction of the width-of-print is necessary.

While the inspection of the signatures for print defects can be conducted manually by the operator reviewing a sample signature in the manner described above, the inspection of the print quality of the signatures can also be conducted automatically using a known register mark detection system 31, such as the MICROTRAK CCR register detection device manufactured by Web Controls, Inc. The register mark detection device 31 analyzes, for example, the register marks 3, 4 or 5, 6, respectively, shown in FIG. 1 automatically determines that the fit of the signature needs to be adjusted, e.g., that a width-of-print adjustment to the signature is required. Conventional register mark detection devices may also identify print defects in signatures by analyzing sequences of dots that are printed at each printing unit of the press 70, the sequence of dots from each printing unit being aligned with one another, misalignment indicating that a width-of-print adjustment is necessary via the register correction wheel 8 associated with the location of the print defect. Alternatively, control signals to the actuating unit 21 can be initiated automatically by the central press control system 27 based on data indicating that a certain event will occur, such as a splice or blanket wash.

As shown in FIG. 4, the operator 30 activates, via the interface unit 26, a central press control system 27 which, in turn, controls the actuator unit 21 assigned to a register correction wheel 8 of a particular printing unit. The interface unit 26 including, for example, a remote control, or other data entry means, such as a keyboard or touch screen. According to correction values input into interface unit 26 by operator 30, for example, the actuator unit 21 drives the spindle 22, which in turn moves the register correction wheel 8 into an upward position via the threads 15, thereby causing the outer circumference 9 to touch the lower surface of the web of material 1. Thus, the web of material 1 is slightly deviated out of its conveying plane causing the width-of-print 7 to narrow upon entry into the following printing unit to the extent the operator has determined. As a result, for example, register mark 4 in the lower half of FIG. 1 will become register mark 6 in the upper half of FIG. 1, indicating that the lateral register is correct and requires no further adjustment operations. Similarly, an additional actuating unit 21 and position monitoring unit 20 coupled to the housing 19 via, for example, the threaded rod 15.1, as shown in FIG. 6, can be directed by the operator 30 to move the lateral position of the register correction wheel 8.

When the width-of-print 7 is corrected through an upward movement of the register correction wheel 8 so that the outer circumference 9 touches the web of material 1, the new vertical position of the register correction wheel 8 is monitored by the potentiometer 20 as a result of the movement of the spindle 22. The position of the respective register correction wheel 8 is fed back to the microprocessor 60, 61, 62, 63, so that each embedded controller for a respective print unit 40, 41, 42, 43 can determine when the register correction wheel 8 is in the desired position. The central press control system 27 provides the position information to the operator interface unit 26 so that the position data can be displayed to the operator. For example, the press control system can include a bar graph display panel having a plurality of columns of light emitting diode (LED) arrays, the number of bars of LEDs displayed corresponding to the position of the register correction wheel.

Using the register mark detection device 31, which is coupled, for example, to the operator interface unit 26 and to the central press control system 27, detection and correction of print defects can be achieved without the intervention of the press operator. For example, the register mark detection device 31 can include an optical scanner that monitors register marks 3 and 4 shown in FIG. 1, evaluates the lateral registration of the signature to keep each register mark "on" (e.g., a proper fit of the register mark lines) by making a width-of-print adjustment to the signature via register correction wheel 8, such that correct register marks 5 and 6 result. Alternatively, the register mark detection device 31 can monitor a sequence of color dots, as is known in the art, to detect misalignment of the signature in a particular printing unit for each color printed and determine the appropriate adjustment that must be made to the width-of-print.

The benefit of the quick register correction wheel activation after detection of a width-of-print defect according to the present invention is a significant reduction of waste produced between detection of a defect and its correction and increased press operating time. According to the present invention, there is no longer a need for the operator 30 to manually adjust a certain register correction wheel 8, then return to the console to check another sample, then manually adjust a register correction wheel 8 again, etc. As a result, there will be printed a larger number of high-quality prints in a shorter time with significantly reduced waste.

Another benefit of the present invention is the presetting of each register correction wheel 8. For example, upon set-up of a new print job, the register correction wheel 8 can adopt a particular predetermined lateral and vertical position with respect to the width-of-print 7 automatically. Data for the vertical and lateral positioning of the register correction wheel 8 from previous print jobs can be stored, for example, in a database in the central press control system 27. The data in the database can be recalled by the operator 30, via the central press control system 27, to quickly preset the register correction wheel 8 when performing a similar print job.

Furthermore, in accordance with the register correction assembly 100 of the present invention, the actuating unit 21 driving the register correction wheel 8 in the vertical direction can lower the register correction wheel 8 when a web splice passes the register correction wheel 8 when the central press control system 27 knows that a web splice is being processed, as is known in the art. As a splice is generally somewhat thicker than the web of material 1 since the ends of two different webs of material slightly overlap, a register correction wheel 8 in an actuated position could otherwise have a detrimental effect on the passing web splice by causing an unwanted change to the width-of-print 7. Automatic lowering of the register correction wheel 8 avoids such a result. Automatic lowering of the register correction wheel 8 during web-up of a press is also very useful upon web-up, as correction of the position of the web of material 1 with regard to lateral register is not necessary. Accordingly, the central press control system 27 can signal the actuating unit 21 to lower the register correction wheel 8 during web-up.

Therefore, the register correction wheel assembly which is integrated into the central press control system 27 according to the present invention allows for a quick response time to correct register defects, thereby significantly reducing make-ready time and web waste.

What is claimed is:

1. A register adjustment system for providing register adjustment to a web of material, the register adjustment system comprising:

a register correction wheel, a position of the register correction wheel being controlled to deflect a portion of the web of material and adjust a width-of-print of the web of material, the register correction wheel being movably disposed along a path of the web of material;

a control unit;

a first actuating unit connected to the register correction wheel and to the control unit, the first actuating unit actuating the register correction wheel to chance the position of the register correction wheel relative to the web of material, thereby adjusting the width-of-print of the web of material; and a first position monitoring device coupled to the register correction wheel and to the control unit, the first position monitoring device monitoring a position of the register correction wheel.

2. The register adjustment system according to claim 1, wherein the register adjustment system is incorporated into a press including a central press control system and wherein the control unit is integrated into the central press control system.

3. The register adjustment system according to claim 1, further comprising a second actuating unit coupled to the register correction wheel and a second position monitoring device coupled to the register correction wheel, the second actuating unit actuating the register correction wheel in a lateral direction with respect to the web of material and wherein the register correction wheel is automatically actuated by the first actuating unit in response to a first control signal from the control unit in a vertical direction with respect to the web of material.

4. The register adjustment system according to claim 3, further comprising a housing, wherein the register correction wheel is movably disposed in the housing, the housing being movable in the lateral direction, the second actuating unit moving the housing and the second position monitoring device monitoring the movement of the housing.

5. The register adjustment system according to claim 4, wherein each of the first and second actuating units includes an electric motor and each of the first and second position monitoring devices includes a variable resistance potentiometer.

6. The register adjustment system according to claim 3, wherein the control unit initiates movement of the register correction wheel in one of the lateral direction and the vertical direction as a function of a subsequent print job data.

7. The register adjustment system according to claim 1, further comprising a housing, wherein the register correction wheel is movably and rotatably mounted on the housing, the housing having an air outlet directed generally toward the web of material.

8. The register adjustment system according to claim 1, wherein the first actuating unit moves the register correction wheel to a predetermined operating position during one of a presetting operation of a printing press, a splicing of the web of material and a web-up operation.

9. The register adjustment system according to claim 1, further comprising a register mark detection device coupled to the control unit, wherein the register mark detection device detects a print defect on the web of material and provides to the control unit a control signal generated as a function of the print defect and the position of the register correction wheel.

10. A device for lateral register adjustment of a web of material in a printing press, comprising:

a housing;

a register correction wheel movably and rotatably mounted to the housing, the register correction wheel being disposed along a path of the web of material;

a first position monitoring unit coupled to the register correction wheel, the first position monitoring unit determining a position of the register correction wheel; and a first actuator connected to the register correction wheel, the first actuator moving the register correction wheel into a selectable position, the selectable position being one of an in-contact position in which the register correction wheel contacts the web of material and an out-of-contact position in which the register correction wheel does not contact the web of material, wherein movement of the register correction wheel between the in-contact position and the out-of-contact position alters the path of the web of material and, consequently, adjusts a width-of-print of the web of material.

11. The device according to claim 10, wherein the first position monitoring unit and the first actuator are connected to a control unit, the control unit providing a control signal to the first actuator.

12. The device according to claim 11, wherein the first position monitoring unit provides a position signal to the control unit, the control unit generating the control signal as a function of the position signal.

13. The device according to claim 11, wherein the printing press includes a central press control system and wherein the control unit is integrated into the central press control system.

14. The device according to claim 11, further comprising a register mark detection device coupled to the first actuator, the register mark detection device detecting a print defect on the web of material and providing a control signal to the control unit, the control signal being generated as a function of the print defect and the position of the register correction wheel.

15. The device according to claim 14, wherein the printing press includes a central press control system and wherein the register mark detection device and the first actuator are integrated into the central press control system, wherein the central press control system automatically controls the first actuator such that the path of the web of material and the width-of-print of the web of material are altered to remove the defect.

16. The device according to claim 10, wherein the register correction wheel is automatically moved by the first actuator in a vertical direction with respect to the web of material and wherein the first position monitoring unit includes a variable resistance potentiometer.

17. The register adjustment system according to claim 16, wherein the housing includes an air outlet formed in an outer surface thereof.

18. A The device according to claim 10, further comprising a second actuator coupled to the housing and a second position monitoring unit coupled to the housing, the second actuator actuating the housing in a lateral direction.

19. The register adjustment system according to claim 10, wherein the first actuator actuates the register correction wheel to a predetermined operating position during a presetting operation.

20. The register adjustment system according to claim 10, wherein the register correction wheel is automatically moved to a predetermined one of the in-contact and out-of-contact positions during one of a splicing of the web of material and a web-up operation.

* * * * *

UNITED STATES PATENT AND TRADEMARK OFFICE

CERTIFICATE OF CORRECTION

PATENT NO. : 5,794,829
DATED : August 18, 1998
INVENTOR(S) : M. Perreault

It is certified that error appears in the above-identified patent and that said Letters Patent is hereby corrected as shown below:

Title page,
Item [76], Inventor, please change "Perrault" to -- Perreault --.

Signed and Sealed this

Third Day of August, 2004

JON W. DUDAS
*Acting Director of the United States Patent and Trademark Office*